United States Patent [19]

Audet

[11] Patent Number: 4,644,645

[45] Date of Patent: Feb. 24, 1987

[54] RAZOR HOLDER

[76] Inventor: Gerard Audet, 19 Redfern St., North Providence, R.I. 02911

[21] Appl. No.: 814,156

[22] Filed: Dec. 23, 1985

Related U.S. Application Data

[63] Continuation of Ser. No. 537,027, Sep. 29, 1983, abandoned.

[51] Int. Cl.[4] ..... B26B 19/44

[52] U.S. Cl. ..... 30/41; 30/85; 30/90

[58] Field of Search ..... 30/41, 85, 90, 296 A; 211/60 R, 60 T, 60 M, 63, 65, DIG. 1, 60.1, 63, 66, 69.9; 206/228; 220/85 R

[56] References Cited

U.S. PATENT DOCUMENTS

| | | | |
|---|---|---|---|
| 2,075,721 | 3/1937 | Hommel | 220/85 R |
| 2,192,569 | 3/1940 | Williams | 211/DIG. 1 |
| 3,536,285 | 10/1970 | Vaughn | 211/65 |
| 4,074,428 | 2/1978 | Roberts | 30/41 |
| 4,320,832 | 3/1982 | Edstrom | 206/228 |

*Primary Examiner*—Douglas D. Watts

*Attorney, Agent, or Firm*—Eugene F. Malin

[57] ABSTRACT

A razor mountable on a can of shaving soap, or other suitable surface, the purpose of which is to provide storage for the razor between uses. Various schemes to attach the razor to the can are disclosed, including resilient clips that can either lodge on, or snap fit about, a rim on the can, and which are attached to the razor by adhesive, magnets, or are manufactured unitary with the razor. Alternatively the clips may have a cap that locks onto and grips the razor, or the razor may be provided only with magnets, which directly attach the razor to, e.g., the metal can or any metallic surface. As a further alternative, the clips may have tubes or rings, into which a razor can be inserted and permanently stored.

2 Claims, 7 Drawing Figures

RAZOR HOLDER

This application is a continuation, of application Ser. No. 537,027, filed Sept. 29, 1983.

BACKGROUND OF THE INVENTION

Convenience is no less a marketable commodity than debentures or commodity futures. For example, when shaving soap in aerosal cans first entered the market, many felt that such shaving soap dispensers could never gain a significant part of the market. For who, it was reasoned, would buy such expensive cans and expensive technology, when one could buy a simple bar of shaving soap that costs virtually nothing and lasts virtually forever. The exact opposite result has occured, and today bars of shaving soap command only a miniscule portion of the shaving soap market and indeed are often quite difficult to find in commercial outlets.

As anyone who must use a razor knows, its use is made inconvenient by the razor's tendency to become lost between uses, or otherwise contributes to clutter in one's bathroom. This commonplace experience suggests that any invention enabling a user to permanently store his razor between uses in a specific and easily remembered place would contribute greatly to the user's convenience. Additionally because the razor's user typically must also have a can of shaving soap, it would be especially convenient for such an apparatus to enable the user to store his razor on the shaving soap can itself.

The prior art does disclose stowable razor systems. Examples of such prior art are U.S. Pat. Nos. 2,429,352 to Garritson; 4,074,428 to Roberts; 3,349,484 to Zeles and 4,332,321 to Wratschko, each of which shows a razor with a pocket clip. Further prior art examples are U.S. Pat. Nos. 3,111,757 to Dubofsky (showing a receptacle base for a razor), and 1,228,261 (tubular receptacles for storing toothbrushes, which could be used to store razors). Other prior art razors show lip structures which could, using hindsight, be used to attach the razors to ledge structures (such as the rim about a can of shaving soap); examples of these are: U.S. Pat. Nos. 840,965 to Schmachtenberg (see member B2), and 1,534,665 to Savage (see member M7). None of these razors are mountable on the soap dispenser itself, and most require cumbersome attachments that themselves can clutter one's bathroom or become lost.

SUMMARY OF THE INVENTION

Thus, it is an object of the invention to provide a razor that can be easly stored between uses, and prevent the razor from becoming lost or contribute to a disorderly appearance in one's bathroom.

It is a further object of the invention to provide a razor that can be stored between uses on a conventional shaving soap can, or other similar structures.

To secure these and other objects that shall become apparent herein, there is disclosed a razor provided with various means to attach the razor to a conventional shaving soap can or other similar suitable surfaces. The attaching structures may be resilient clips that locate about ledges on the can, or magnets on the razor's body that attach the razor to the metal soap dispenser. The magnets can be impregnated in the razor, or be attached thereto by adhesive. The clips themselves are secured to the razor body by adhesive or by additional magnets. Alternatively the clips may be unitary with the razor's body. As a further alternative, the clips can be secured to a tube or ring mechanically depending from the clips, into which the razor can slidingly locate; or to a cap, also mechanically depending from the clips, into which the razor's head can locatingly snap. The razor's body may also have protruberances, the purpose of which is to space the razor's body from any surface to which the razor is attached, and hence stabilize the mounted razor.

The instant invention will be more fully understood from the following detailed description, it being understood, however, that the invention is capable of extended application, and is not confined to the precise disclosure. Changes and modifications may be made that do not affect the spirit of the invention, nor exceed the scope thereof, as expressed in the appended claims. Accordingly the instant invention will now be described with particular reference to the accompanying drawings.

DETAILED DESCRIPTION OF THE INVENTION

Figure 1:
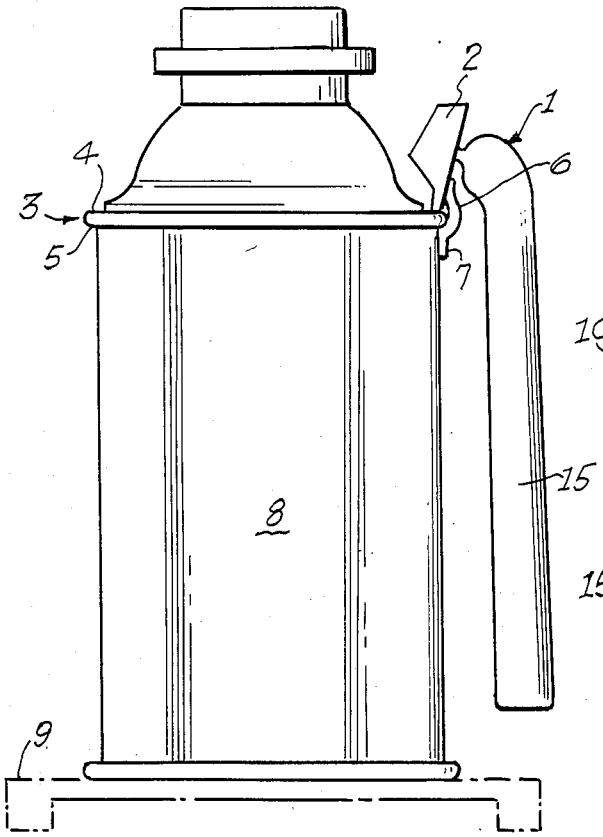
FIG. 1 is an elevational view showing a razor mounted on a conventional shaving soap dispenser by means of a first embodiment of the instant invention.

With particular reference to FIG. 1, there is shown a conventional shaving soap dispensing can 8 to which is attached razor 1. The can has a rim or a ledge 3 having an upper, or first, section 4, and a lower, or second, section 5. The razor is snap fit into cap 2, which is adapted to lockingly receive the head of the razor 13, said razor head having blade means for shaving (obscured by the cap). Attached to the cap 2, is a pair of resilient arms 6, 7, the purpose of which is to snap fit over ledge 3. The clips and cap can be made of any appropriate material, for example molded plastic, and can be made into one unitary body.

Figure 2:
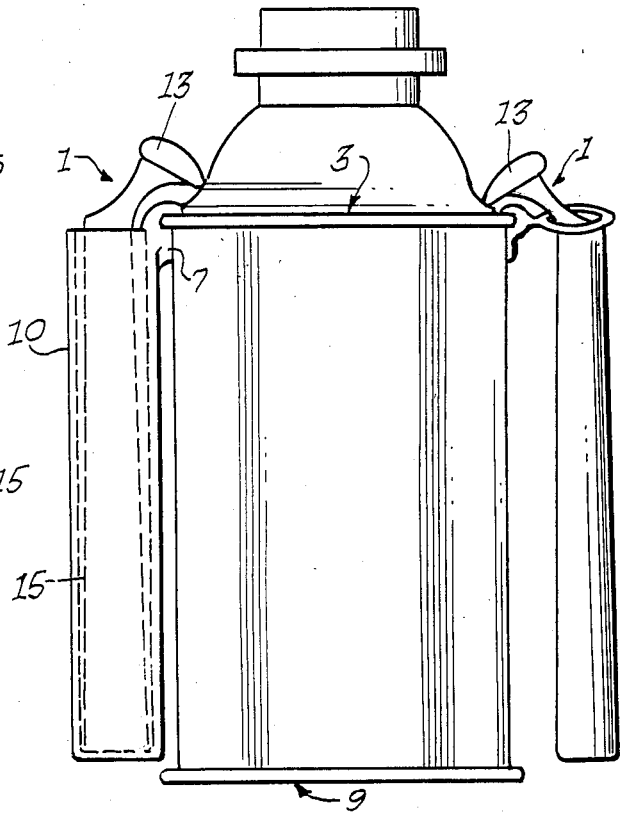
FIG. 2 is an elevational view similar to FIG. 1 showing a second embodiment of the instant invention.

FIG. 2 shows an alternative embodiment, like numbers referring to like structure. In this embodiment, the clips 6, 7 attach to either ring 11 or tube 10. Tube 10 or ring 11 have openings therein that allow a user to insert a portion of razor 1, here razor handle 15, into the tube or ring, thus providing a permanent storage means for the razor.

Figure 3:
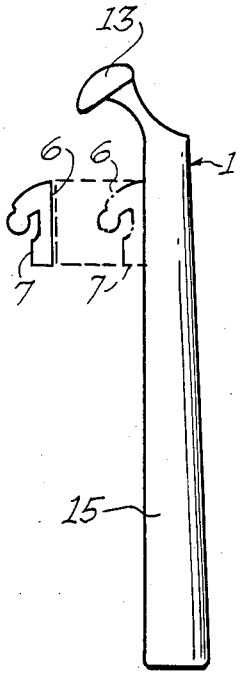
FIG. 3 shows an elevational view of a third embodiment of the instant invention.

FIG. 3 shows an alternative means for supporting the razor. Here, instead of a cap locating over the razor's head, the clip is directly attached to razor handle 15. Any suitable attaching means 16 can be used, for example permanent adhesive or magnets. If the latter is chosen, one could, for example, provide razor handle 15 with an implementation of metallic material (as discussed more fully below), or place a metal strip on handle 15.

Figure 4:
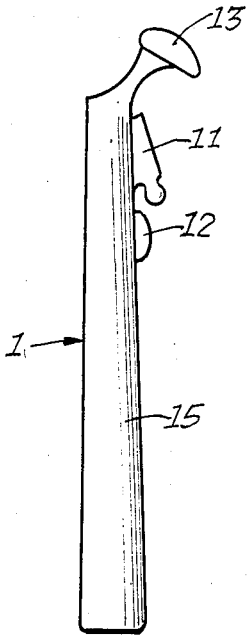
FIG. 4 shows an elevational view of a fourth embodiment of the instant invention.

FIG. 4 shows another embodiment of the invention. Here, single arm clip 11 is placed on razor handle 15, and protuberance 12 is placed below clip 11. Clip 11 can locate over any suitable mounting ledge, for example rim 3 of can 8, and protuberance 12 serves to abut the mounting surfaces so as to stabilize the razor thereon by preventing the razor from swinging excessively about rim 3. Again clip 11 or protuberance 12 can be manufactured by any suitable means, for example unitary molding with razor handle 15 or attachment to handle 15 by adhesive or magnets as described above.

Figure 5:
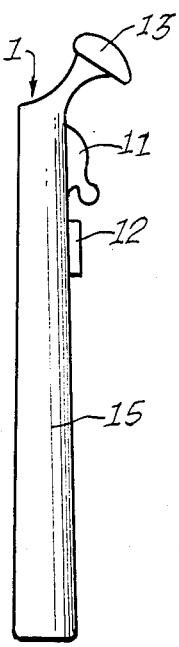
FIG. 5 shows an elevational view of a fifth embodiment of the instant invention.

FIG. 5 shows another embodiment of the invention similar to that of FIG. 4 except that the protuberance is a magnet 12'. If the razor is mounted on a metallic surface, such as it would be if mounted upon a shaving soap dispenser, the magnetic attraction between the metallic surface and magnet 12' would add additional stability to the mounted razor.

Figure 6:
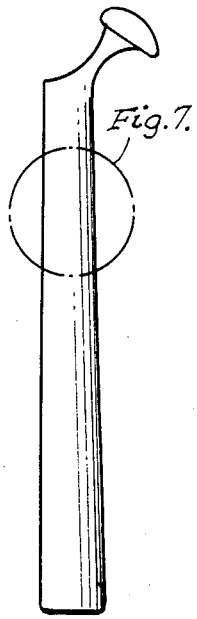
FIG. 6 shows an elevational view of a sixth embodiment of the invention.
Figure 7:
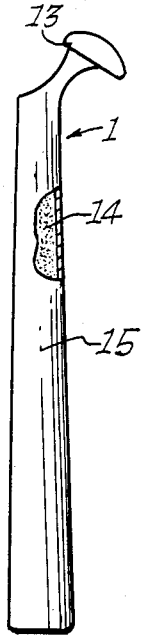
FIG. 7 shows an elevational view, partly broken away along lines 7—7 of FIG. 6, of the sixth embodiment of the instant invention.

FIGS. 6 through 7 show another embodiment of the invention, here with magnetic particles 14 impregnated in razor handle 15. Part of handle 15 is cut away in FIG. 7 so as to better illustrate these particles. Such impregnated particles can serve any of the magnetic functions recited above, or alternatively can, in conjunction with razor head 13, used as clip 11 is used above, i.e. to constitute the sole mounting means for the razor.

Although the invention is here described by several embodiments, this division is for illustrative purposes only. In particular, one can certainly use structure from one embodiment advantageously with that of another to secure the above disclosed advantages. More generally, the instant invention has been shown and described herein in what is considered to be the most practical and preferred embodiments. It is recognized, however, that departures may be made therefrom within the scope of the invention, and that obvious modifications may occur to a person skilled in the art.

What I claim is:

1. A razor holding system for maintaining an orderly appearace in one's bathroom including a closed container of shaving cream foam and a razor holding article for a razor having a handle to hold a razor on the generally vertical ledge on the top of said closed container, comprising:

a ledge mounting means for mounting said article on the ledge of said closed container of shaving cream foam, and a connecting means for permanently connecting said mounting means to said razor nearest the end used for shaving thereof, said connecting means connected to said mounting means, said mounting means is a clip means having a mouth movable over said ledge of said container to hold the razor on the container of shaving cream foam, said ledge comprises first and second sides substantially parallel to one another, and said clip means includes a pair of arms forming said mouth adapted to resiliently lock over the first and second sides of the ledge, said razor and said mounting means and said connecting means are parts of one unitary member, said ledge is on the upper edge of said container having a side surface, the end of said razor used for shaving being positioned above the ledge of said container, and said mounting means including a spacer razor support means for spacing the razor from the side surface of said container, said spacer razor support means being a protrusion on said mounting means.

2. A razor holder system as set forth in claim 1, wherein: said connecting means comprises adhesive means for attaching said mounting means to the razor.

* * * * *